US007814926B2

(12) United States Patent
Hoffmeier et al.

(10) Patent No.: US 7,814,926 B2
(45) Date of Patent: Oct. 19, 2010

(54) LIQUID ASPIRATOR

(75) Inventors: Dieter Hoffmeier, Ibbenbüren (DE); Reinhard Wesselmeier, Hörstel (DE); Utz Wagner, Münster (DE)

(73) Assignee: OASE GmbH, Hörstel-Riesenbeck (DE)

( * ) Notice: Subject to any disclaimer, the term of this patent is extended or adjusted under 35 U.S.C. 154(b) by 703 days.

(21) Appl. No.: 10/599,905

(22) PCT Filed: Apr. 14, 2005

(86) PCT No.: PCT/EP2005/003965

§ 371 (c)(1),
(2), (4) Date: Mar. 8, 2007

(87) PCT Pub. No.: WO2005/099542

PCT Pub. Date: Oct. 27, 2005

(65) Prior Publication Data

US 2007/0199595 A1 Aug. 30, 2007

(30) Foreign Application Priority Data

Apr. 14, 2004 (DE) ..... 10 2004 018 504
Sep. 3, 2004 (DE) ..... 20 2004 013 914 U

(51) Int. Cl.
*B67C 3/16* (2006.01)

(52) U.S. Cl. ..... 137/205; 137/256; 604/320

(58) Field of Classification Search ..... 137/205, 137/255, 256, 101.25, 101.27, 110; 604/35, 604/318–320, 323, 324, 326; 417/7, 8, 62; 141/65, 95, 323, 324
See application file for complete search history.

(56) References Cited

U.S. PATENT DOCUMENTS

| | | | | |
|---|---|---|---|---|
| 1,000,973 | A * | 8/1911 | Alger | 73/222 |
| 3,605,786 | A * | 9/1971 | Machin, Jr. | 137/205 |
| 3,863,664 | A * | 2/1975 | Holbrook et al. | 137/205 |
| 4,384,580 | A * | 5/1983 | Leviton | 604/320 |
| 5,832,948 | A * | 11/1998 | Schell | 137/93 |
| 6,314,978 | B1 * | 11/2001 | Lanning et al. | 137/1 |
| 2003/0221412 | A1 * | 12/2003 | Harrington | 60/259 |
| 2004/0111825 | A1 | 6/2004 | Kaufmann et al. | |

FOREIGN PATENT DOCUMENTS

| | | |
|---|---|---|
| DE | 102 40 804 A1 | 3/2004 |
| GB | 241960 | 10/1925 |
| WO | 95/18685 A1 | 7/1995 |

* cited by examiner

*Primary Examiner*—John Rivell
*Assistant Examiner*—Craig M Schneider
(74) *Attorney, Agent, or Firm*—Gudrun E. Huckett

(57) ABSTRACT

A liquid aspirator, in particular for liquids containing solids such as sludge, has a receptacle into which liquid can be sucked in by an aspirator motor through a vacuum connector and from which the liquid can drain through a drainage. The receptacle has at least two separate receiving chambers and a control that controls that the receiving chambers are filled alternatingly with liquid while the receiving chambers that are not being filled are drained. The receiving chambers are sealable relative to the vacuum side of the aspirator motor by main valves that are preferably mechanically connected.

32 Claims, 14 Drawing Sheets

LIQUID ASPIRATOR

BACKGROUND OF THE INVENTION

The invention relates to a liquid aspirator for vacuuming or transporting liquids, in particular liquids containing solids such as sludge or the like. Such a liquid aspirator is disclosed in DE 102 40 804 A1. It has a receptacle in which by means of an air aspiration motor a vacuum is generated. As a result of the vacuum, the liquid or the sludge is sucked into the receptacle through a vacuum connection and, after filling the receptacle and switching off the motor, can be drained from the receptacle through a drainage and a drain element, usually in the form of a hose, and can be guided to a desired location.

Such sludge aspirators operate reliably because damage to the motor by entrained solids is prevented as a result of separation of motor and liquid or sludge to be transported by means of the receptacle. However, after each filling process of the receptacle an aspiration break is required in which the receptacle must be emptied. The liquid or sludge aspiration is therefore comparatively time-consuming.

It is an object of the invention to provide a liquid aspirator that is improved in this respect.

SUMMARY OF THE INVENTION

According to the invention, this problem is solved by a liquid aspirator wherein the receptacle has at least two separate receiving chambers and a control, by which alternatingly filling of one of the receiving chambers with liquid is realized while at the same time the other receiving chamber is drained. By providing the receptacle of the liquid aspirator with at least two separate receiving chambers and by providing a control with which an alternating filling with liquid and draining of the receiving chambers can be initiated, the liquid or sludge aspiration process can be continuously performed because liquid can always be sucked into one of the chambers while the other chamber is simultaneously drained and room is thus provided for the next filling.

Preferably, the liquid aspirator according to the invention operates with two receiving chambers. Each of the receiving chambers can have a separate motor associated therewith wherein the control can be configured simply in that it switches on and off the motors alternatingly. In this way, the liquid drains under its own weight from the chamber whose motor is presently switched off while the other motor that is switched on sucks liquid into the other receiving chamber.

In an especially preferred embodiment, only one aspirator motor is provided and the control is designed such that the vacuum side of the motor is connected alternatingly to the different receiving chambers so that in this case the receiving chambers can also be alternatingly filled and drained. The aspirator motor can therefore run continuously and is therefore more efficient. In the receiving chamber to which the vacuum side of the aspirator motor is currently connected, liquid is sucked in while no vacuum is applied to the other receiving chamber so that the liquid contained therein can drain under its own weight. As soon as this chamber is completely or mostly drained, the process is reversed and the presently empty chamber is connected to the vacuum side of the aspirator motor in order to be filled again.

The aspirator motor can be configured as desired, for example, as an air aspirator or a vacuum pump.

The control can be realized electronically but also by time control. However, it is preferably embodied as a mechanical control or switch because, in this way, minimal maintenance is required and minimal sensitivity relative to external effects and possible faulty usage, for example, tilting of the aspirator, is achieved.

BRIEF DESCRIPTION OF THE DRAWINGS

Further advantages and details of the invention result from the dependent claims and the embodiments of the invention illustrated in the drawings which will be explained in the following. It is shown in:

DESCRIPTION OF PREFERRED EMBODIMENTS

Figure 1:
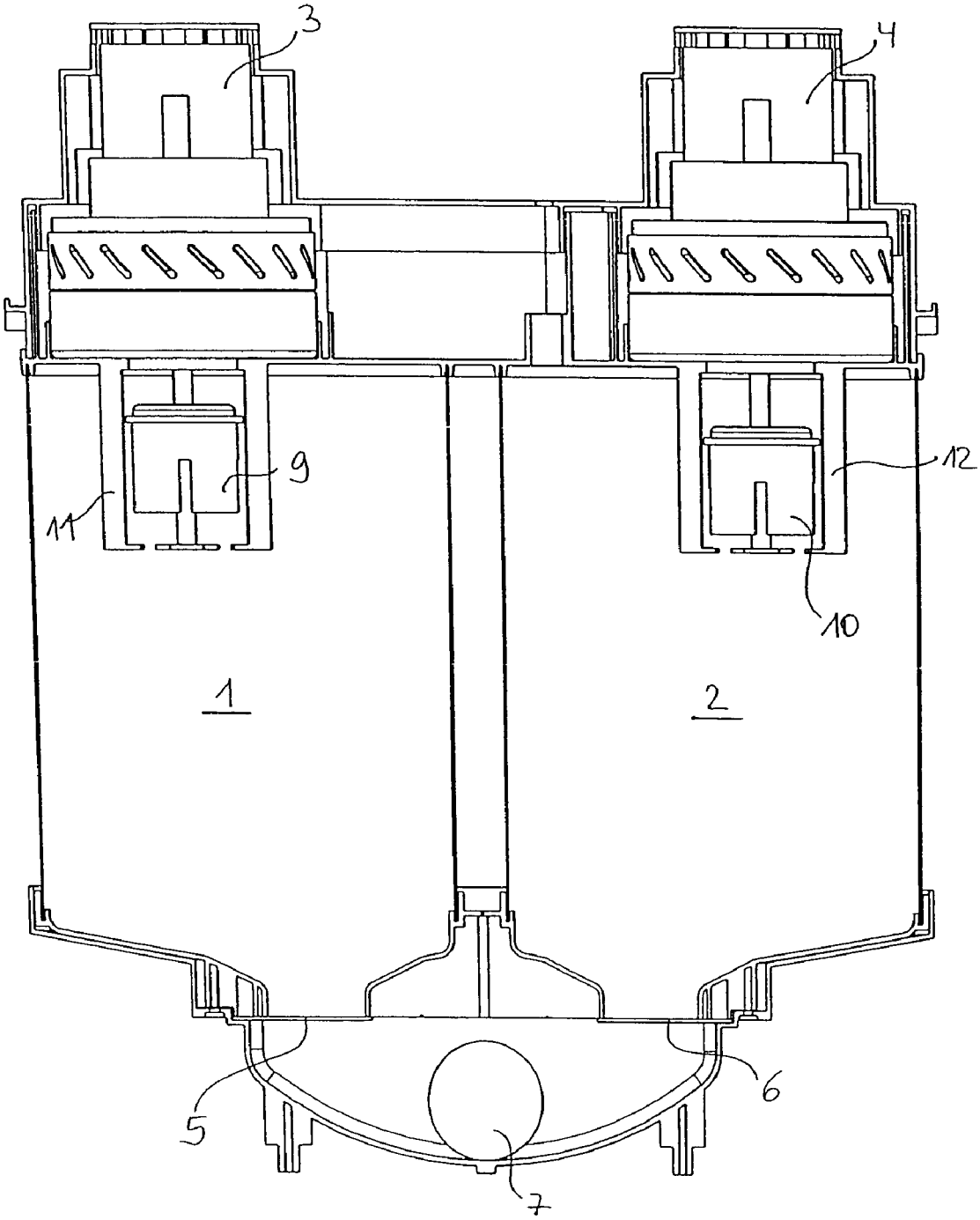
FIG. 1: a liquid aspirator with two motors in section.

In FIG. 1 a liquid aspirator is schematically shown that is provided with two separate receiving chambers 1, 2. Each receiving chamber 1, 2 has associated therewith its own aspirator motor 3, 4. By means of the aspirator motors 3, 4, a vacuum can be generated in the chambers 1, 2 so that by means of a vacuum connector, not illustrated, that opens in the upper area into the receiving chambers 1, 2, liquid can be sucked into the receiving chambers 1, 2. If, for example, the receiving chamber 1 is filled to a predetermined level with liquid, the aspirator motor 3 will shut off. Under the liquid's own weight, the vacuum flap 5 that closes off the receiving chamber 1 at the bottom will open and the liquid will drain through the drainage 7 and a drain element connected thereto, for example, a drain hose. By means of a control it is ensured that filling with liquid and draining of the receiving chambers 1, 2 will take place alternatingly so that continuously liquid is sucked in and drained through drainage 7. In the illustrated embodiment, the control is realized by floats 9, 10 that are secured in a guide 11, 12, respectively, so as to be movable in the vertical direction. The floats 9, 10 represent because of their topside configuration at the same time valves with which the receiving chambers 1, 2 can be closed off relative to the vacuum side of the motors 3, 4 so that no liquid will be sucked into the motors. The position of the floats 9, 10 is detected by transducers, for example, dry reed contacts or similar means. When one of the floats 9, 10 has reached its upper end position, the transducer will send the message "chamber full" to an electronic control that switches off the corresponding motor 3, 4 and switches on the other motor 4, 3. However, the motors 3, 4 can also be mechanically actuated by the action of the floats 9, 10 when suitably mounted switches are provided. Also, a purely time-based electronic control of the motors 3, 4 is possible.

Figure 2:
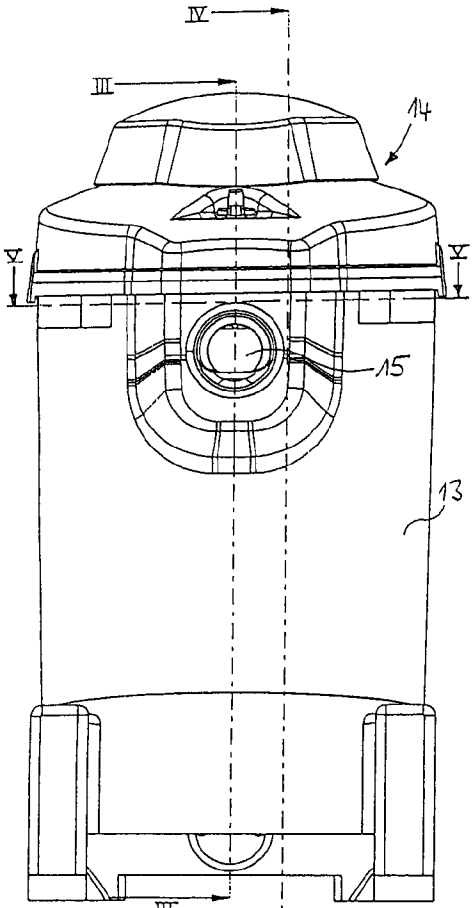
FIG. 2: an external view of another embodiment with one motor.

An especially preferred embodiment of a liquid aspirator according to the invention is illustrated in FIGS. 2 through 11. The external view shown in FIG. 2 illustrates the housing of the liquid aspirator with receptacle 13 and lid 14. A vacuum connector 15 extends into the receptacle 13.

Figure 3:
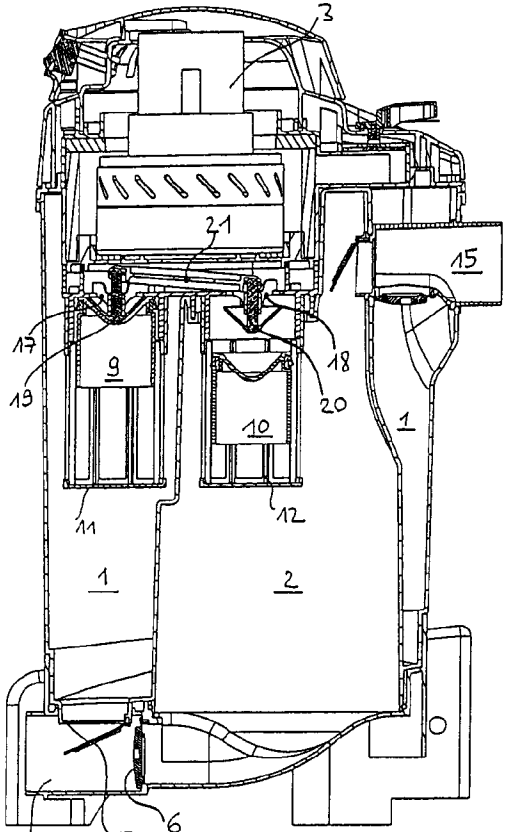
FIG. 3: a section in the direction III-III of the object of FIG. 2.

FIG. 3 shows a central section of the liquid aspirator. It has two receiving chambers 1, 2 in which a vacuum can be created by means of air aspiration openings 17, 18 by means of a single aspirator motor 3. The aspirator motor 3 continuously sucks in air while the air aspiration openings 17, 18 are opened and closed alternatingly by main valves 19, 20 so that only in one of the receiving chambers 1, 2 vacuum is generated. The alternating opening and closing action of the main valves 19, 20 is ensured by a coupling of the main valves 19, 20 that is configured preferably mechanically and is thus not prone to failure. Inasmuch as the liquid aspirator, as in the illustrated embodiment, has two receiving chambers 1, 2, the main valves 19, 20 can be connected in an especially simple way by means of a rigid but pivotably supported rocker 21. The movement of the main valves 19, 20 is introduced by floats 9, 10 that are secured within guides 11, 12 so as to be height-adjustable. When the float 9 has been lifted by the sucked-in liquid to its highest possible position within the chamber 1, as illustrated, it has forced the main valve 19 into the closed position and accordingly has opened the main valve 20. The receiving chamber 1 is no longer connected to the vacuum side of the aspirator motor 3 so that there is no longer vacuum present in it. Because of the own weight of the liquid collected in the receiving chamber 1, which weight is no longer compensated by vacuum, a vacuum flap 5 will open and the liquid can drain through drainage 7 and a connected drain element, not illustrated, for example, a hose.

Figure 4:
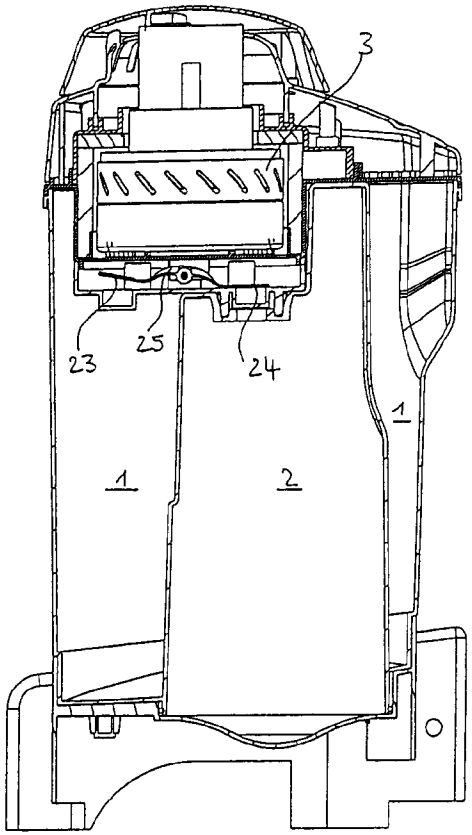
FIG. 4: a section in the direction IV-IV of the object of FIG. 2.
Figure 5:
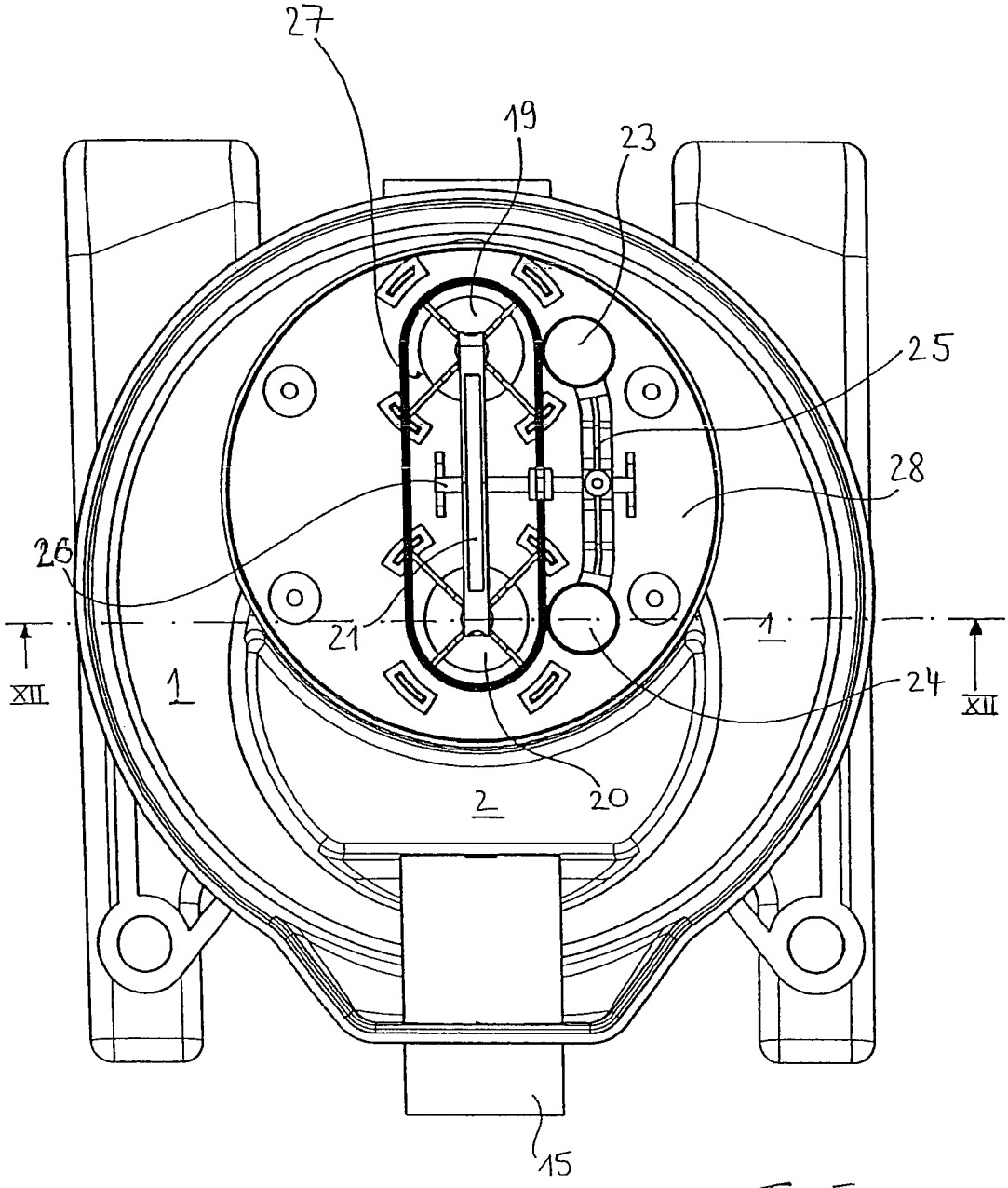
FIG. 5: a section in the direction V-V of the object of FIG. 2.

In the illustrated embodiment draining of the receiving chambers 1, 2 is assisted in that the receiving chambers 1, 2 are connected to the exhaust side or pressure side of the aspirator motor 3 by means of auxiliary valves 23, 24 illustrated in FIGS. 4 and 5. The auxiliary valves 23, 24 are controlled such that, when the main valve 19, 20 is closed, the correlated auxiliary valve 23, 24 of the receiving chamber 1, 2 is open, respectively. For example, in the position of FIGS. 3 and 4, an overpressure is created in the receiving chamber 1 upon draining of the liquid contained therein because of the exhaust air of the aspirator motor 3, which exhaust air is sucked in through the open auxiliary valve 23 into the receiving chamber 1; this overpressure accelerates the draining of the liquid through the vacuum flap 5. The auxiliary valves 23, 24 are preferably also mechanically coupled, preferably also by means of a rocker 25.

In the illustration of FIG. 5 the aspirator motor 3 has been removed; this illustration shows the principle of assisted drainage. The rocker 21 of the main valves 19, 20 and the rocker 25 of the auxiliary valves 23, 24 are rigidly connected to one another by a common pivot axle 26 so as to be only pivotable together about this pivot axle 26 so that they are coupled mechanically in a simple way. It is therefore ensured that the main valve 19 and the auxiliary valve 23 of the receiving chamber 1 or the main valve 20 and the auxiliary valve 24 of the receiving chamber 2 open and close alternatingly, respectively. FIG. 5 also shows that the main valves 19, 20 adjoin a slotted hole-shaped vacuum chamber 27 connected to the vacuum side of the aspirator motor 3 while the auxiliary valves 23, 24 are located in a round pressure chamber 28 surrounding the vacuum chamber 27 and connected to the exhaust side of the aspirator motor 3. The exhaust air of the aspirator motor 3 must not be dissipated completely through the auxiliary valves 23, 24 and the receiving chambers 1, 2 but, depending on the requirements, can also be directly dissipated, partially or completely, into the environment of the liquid aspirator.

Figure 12:
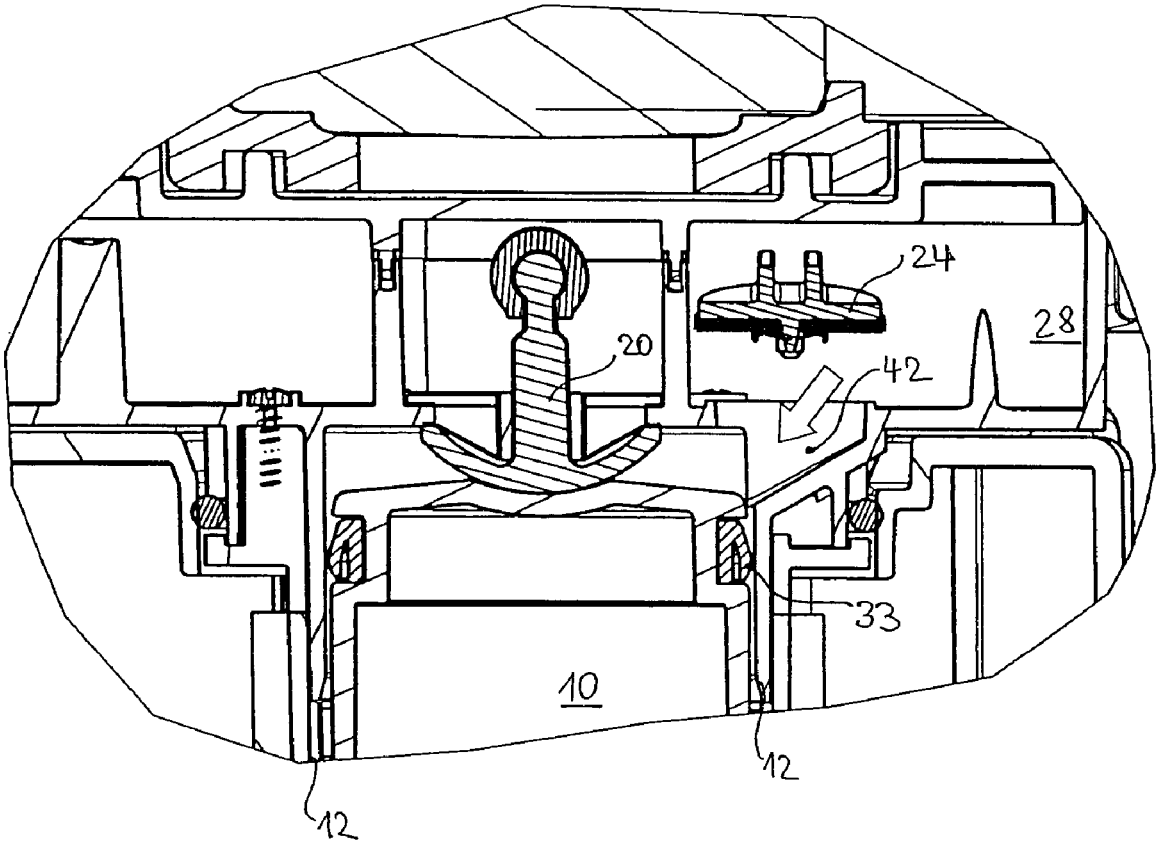
FIG. 12: a detail view in the direction XII-XII of FIG. 5 but of another embodiment.

In an especially preferred embodiment variant that is illustrated in detail in FIG. 12, the exhaust side of the aspirator motor 3, 4 is connected to the receiving chambers 1, 2 by floats 9, 10 and their guides 11, 12. This is particularly advantageous when the float guides 11, 12 are provided with a net, grate, knitted fabric, nonwoven or similar filter for protecting the floats 9, 10 and the main valves 19, 20 from contamination. In a normal situation, this filter would become clogged over time with dirt particles, fine algae or similar materials and therefore would decrease the efficiency of the liquid aspirator. By loading it with the exhaust air of the aspirator motor 3, 4 from the inner side of the float guides 11, 12, for each switch of the aspiration side a small pressure pulse is applied to the filter that cleans off dirt particles and other contaminants from the filter. As illustrated in FIG. 12, the pressure chamber 28 is connected for this purpose on the side facing away from the exhaust side of the aspirator motor 3, 4 by means of a connecting channel 42 to the topside of the float 10 and thus to the inner side of the float guide 12. The other side with auxiliary valve 23 and float 9 is embodied in the same way.

In FIGS. 4 and 5, it can be seen that the receiving chambers 1, 2 are arranged in a special space-saving way eccentrically within one another wherein both receiving chambers 1, 2 have an essentially cylindrical shape, beneficial with regard to pressure, and in essence have the same receiving volume, respectively.

Figure 6:
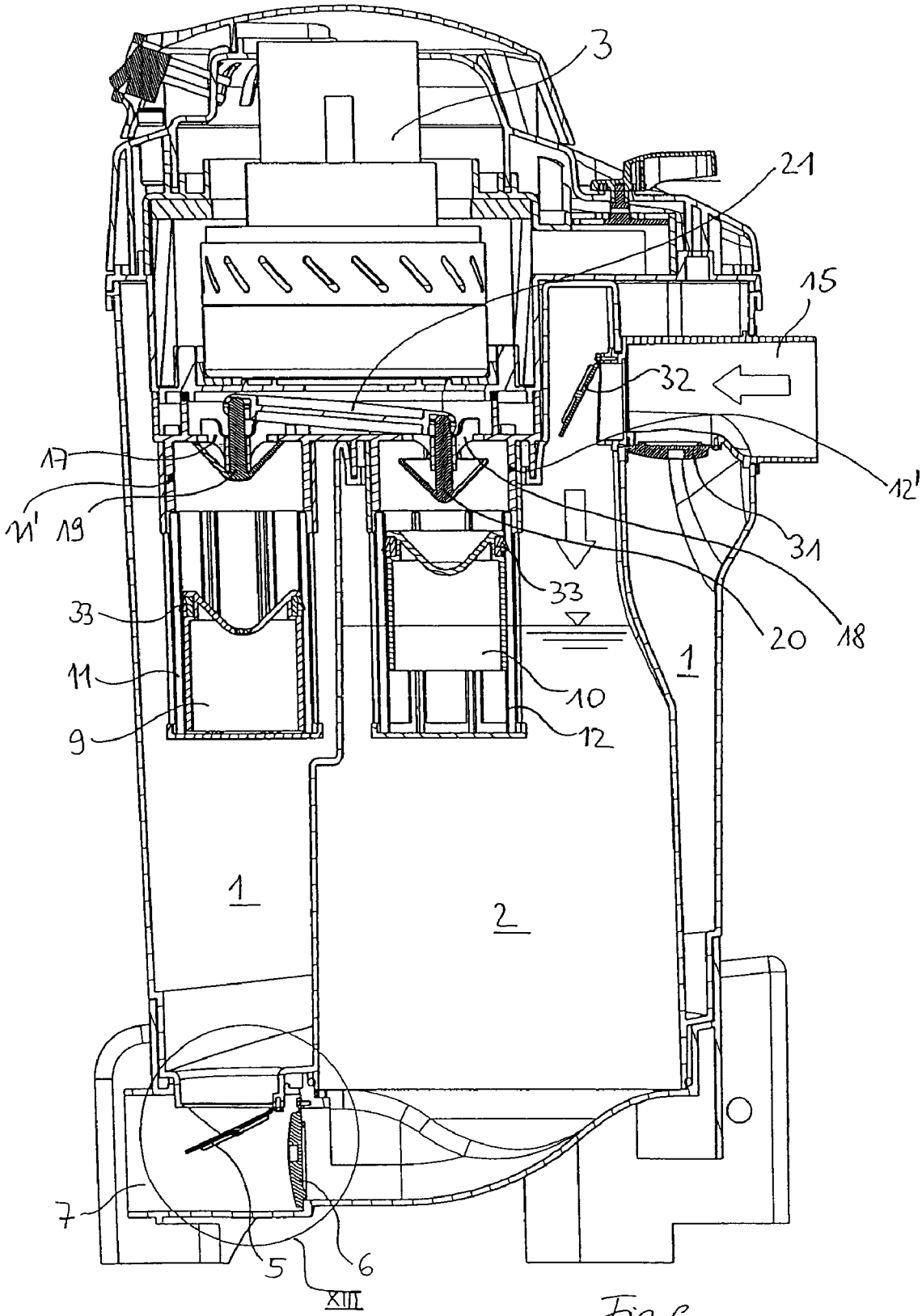
FIGS. 6 to 11: the object of FIG. 3 in different filled and drained states.
Figure 7:
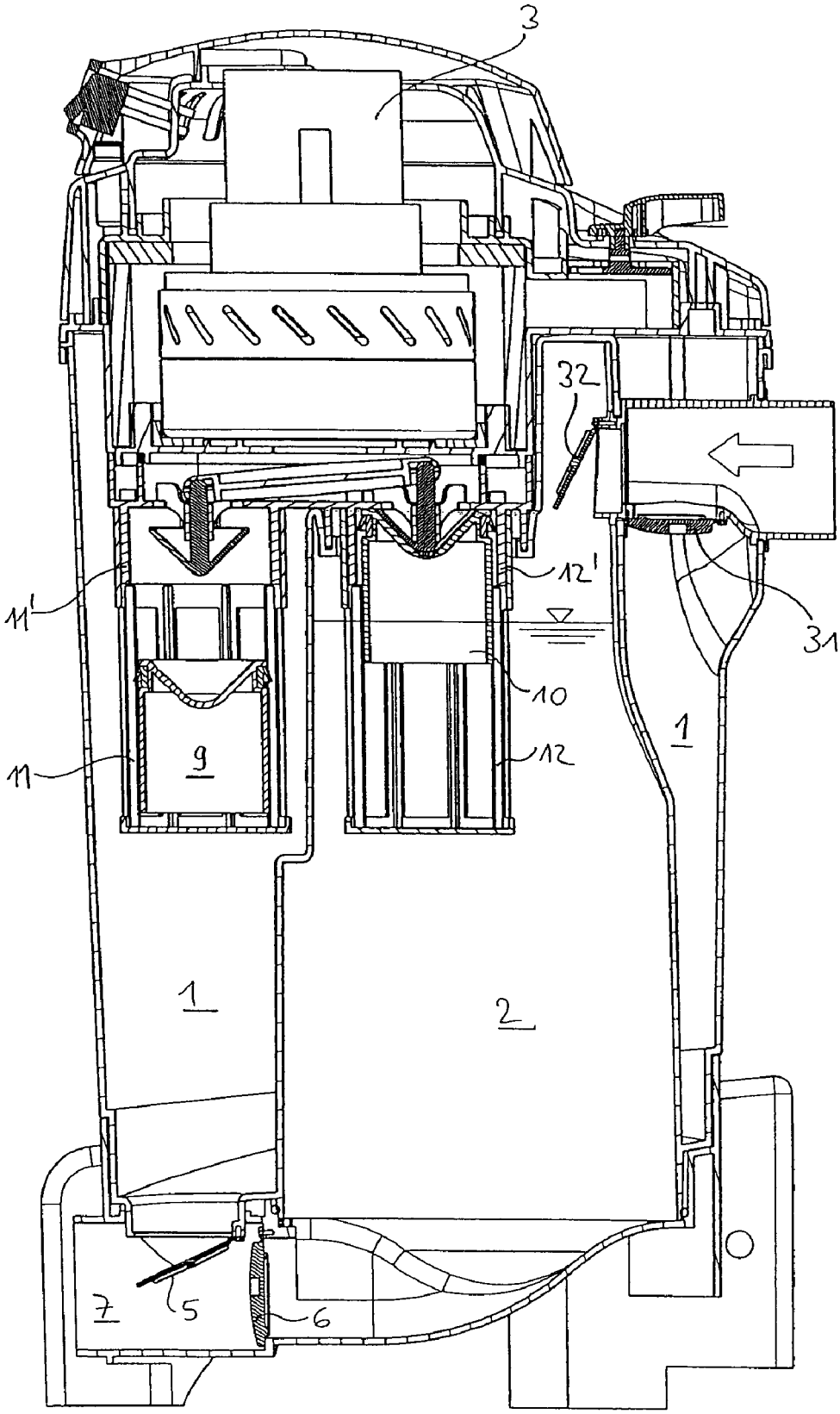

The function of the liquid aspirator will be illustrated in the following with the aid of FIGS. 6 to 11. FIG. 6 shows that the main valve 20 of the receiving chamber 2 is open. In the receiving chamber 2 a vacuum is generated so that liquid, symbolized by arrows in outline, will be sucked into the receiving chamber 2 through the vacuum connector 15 and an open check flap 32. The float 10 is moved upwardly with rising liquid level within the guide 12. The guide 12, as illustrated, is provided with penetrations in the lower area so that the liquid can enter the guide 12. In the upper area 12', the guide 12 is however closed circumferentially. The float 10 has a seal 33 at its upper outer circumference. As soon as this area of the float 10 provided with the seal 33 moves into the upper closed area 12' of the guide 12, in the upper area 12' of the guide 12, dosed off at the bottom, such a strong underpressure is produced because of the suction effect of the aspirator motor 3 that the float 10 is pulled upwardly away from the liquid surface, impacts with its topside provided with a shape that matches approximately the shape of the main valve 20 against the main valve 20, and forces the main valve suddenly in the upward direction and closes it so that, as a result of the coupling of the main valves 20, 19 by means of the rocker 21, the main valve 19 of the other receiving chamber 1 will open. This moment is illustrated in FIG. 7. The special configuration of the guides 11, 12 with areas 11', 12' closed at the topside and of the floats 9, 10 with seals 33 makes it possible that in this embodiment a sufficient impulse is provided mechanically so that the main valve 19 (or in the reverse situation 20) that has been closed up to this point will open despite the underpressure that is present in the vacuum chamber 27 and is generated by the aspirator motor 3.

Figure 8:
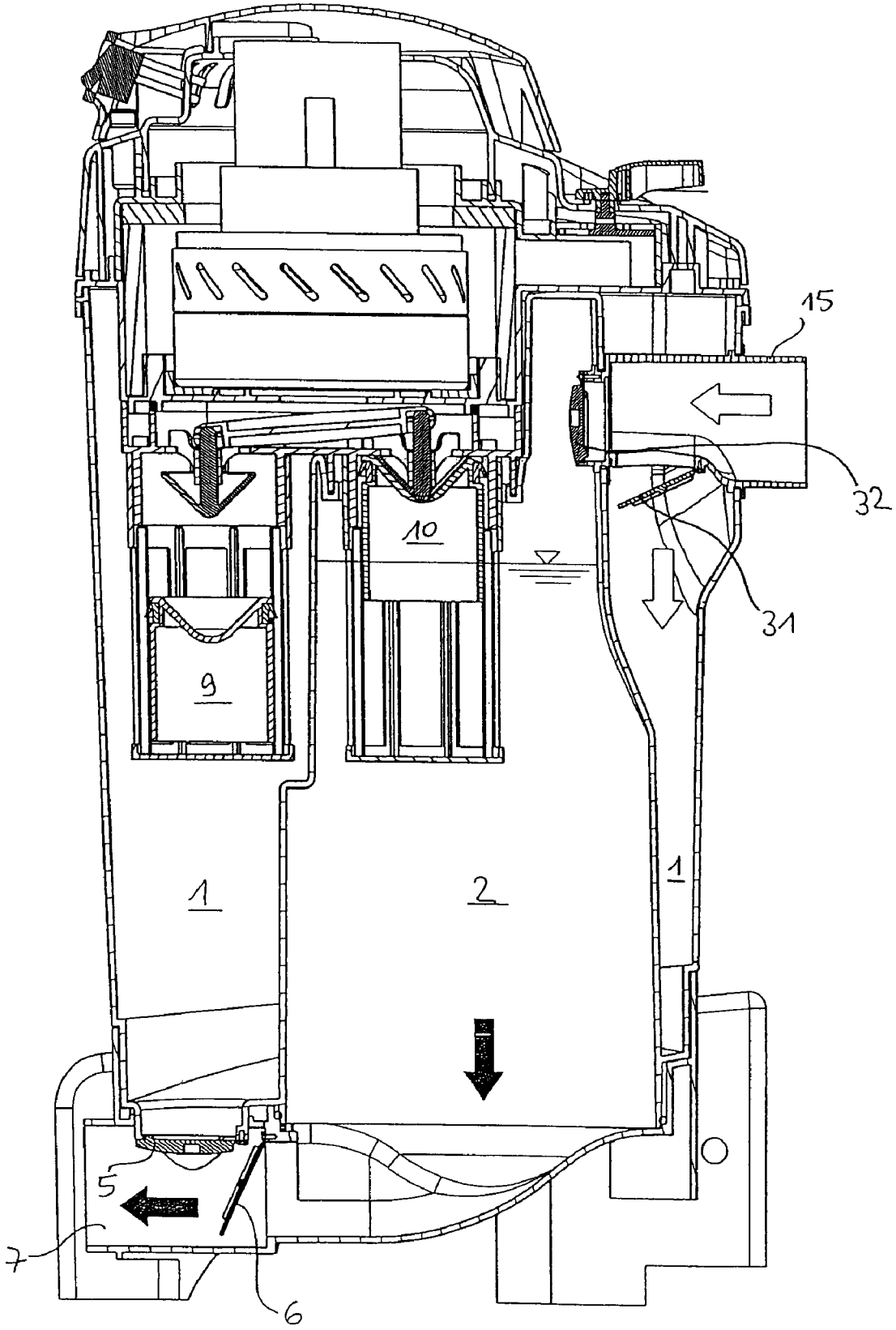

In the illustration according to FIG. 8, a vacuum has already been generated in the receiving chamber 1 so that the vacuum flap 5 is closed. By means of the vacuum connector 15 and the check flap 31 correlated with the receiving chamber 1, liquid that is illustrated by the arrows in outline will now be sucked into the receiving chamber 1. While this takes place, no vacuum is present anymore in the receiving chamber 2 because the main valve 20 is closed. Because of the own weight of the liquid, the vacuum flap 6 will open and the liquid will drain from the drainage 7, as symbolized by the solid arrows.

Figure 9:
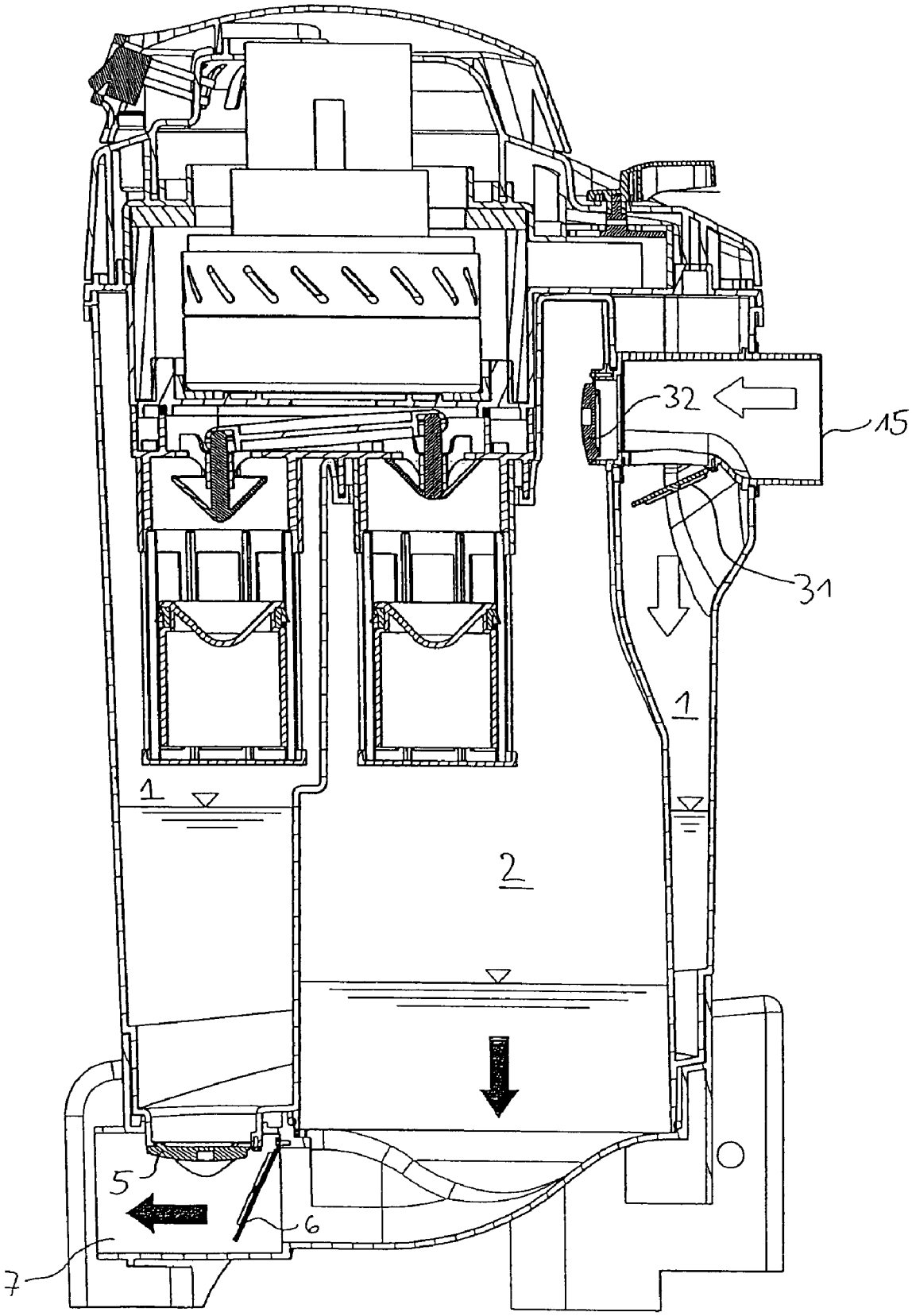
Figure 10:
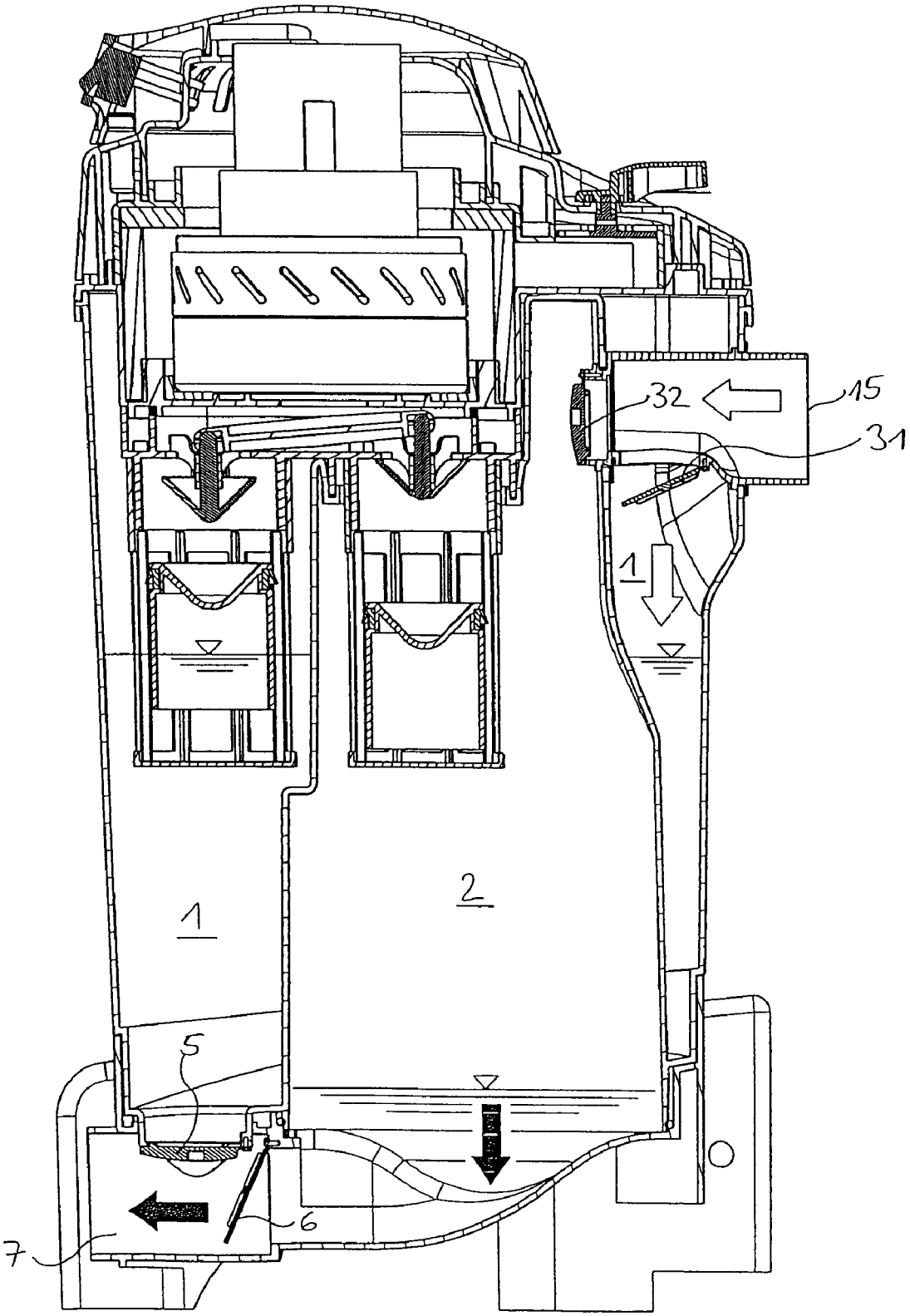
Figure 11:
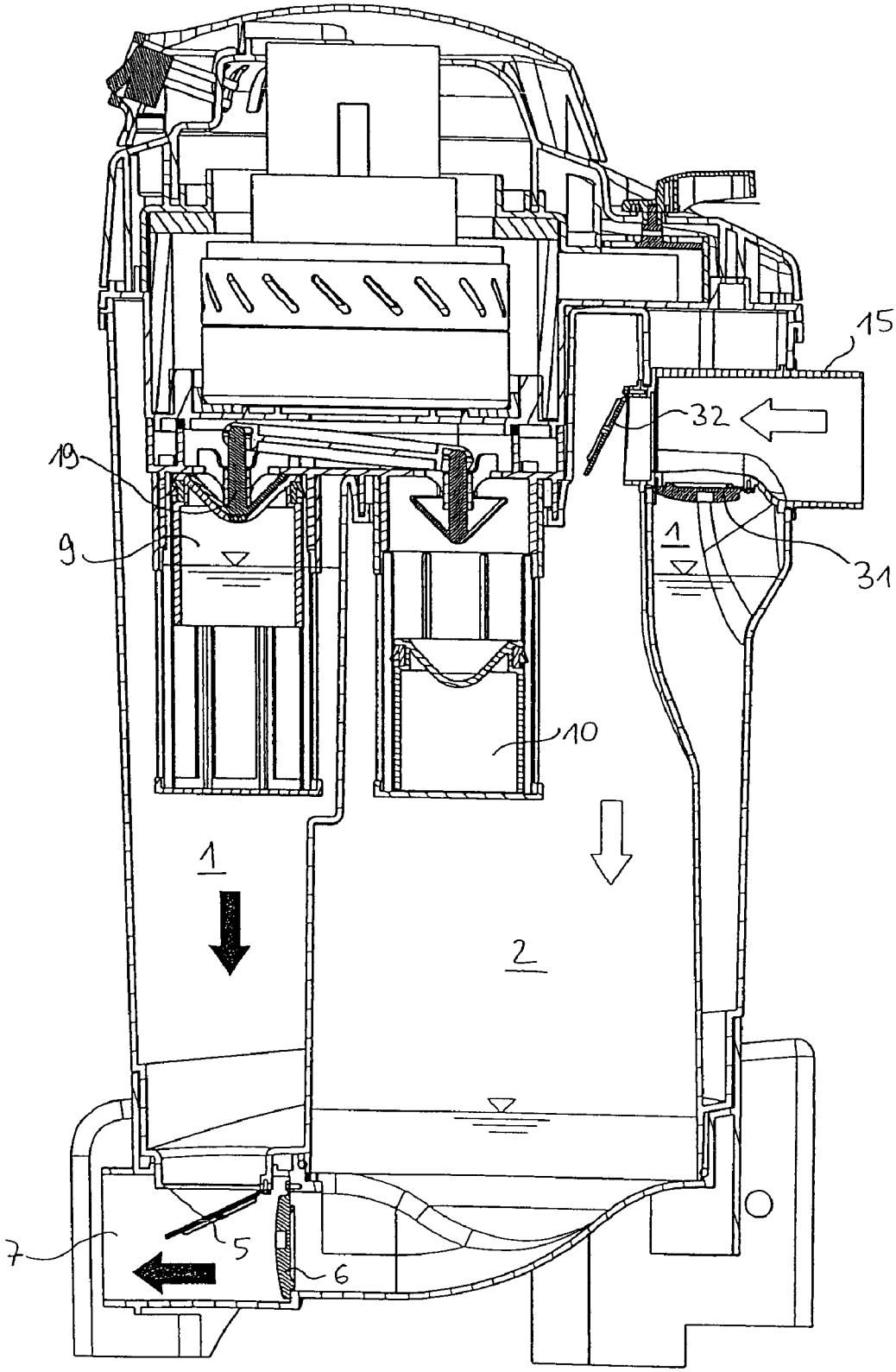

FIGS. 9 and 10 show that, as the receiving chamber 2 is being drained, the receiving chamber 1 will fill with liquid. In FIG. 11, the process has been reversed again. The float 9 has closed off the main valve 19 and the main valve 20 is open. The check flap 31 and the vacuum flap 6 are closed. From the open vacuum flap 5 liquid flows through drainage 7 out of the receiving chamber 1. Liquid is sucked into the receiving chamber 2 through the vacuum connector 30 and the open check flap 32.

Figure 13:
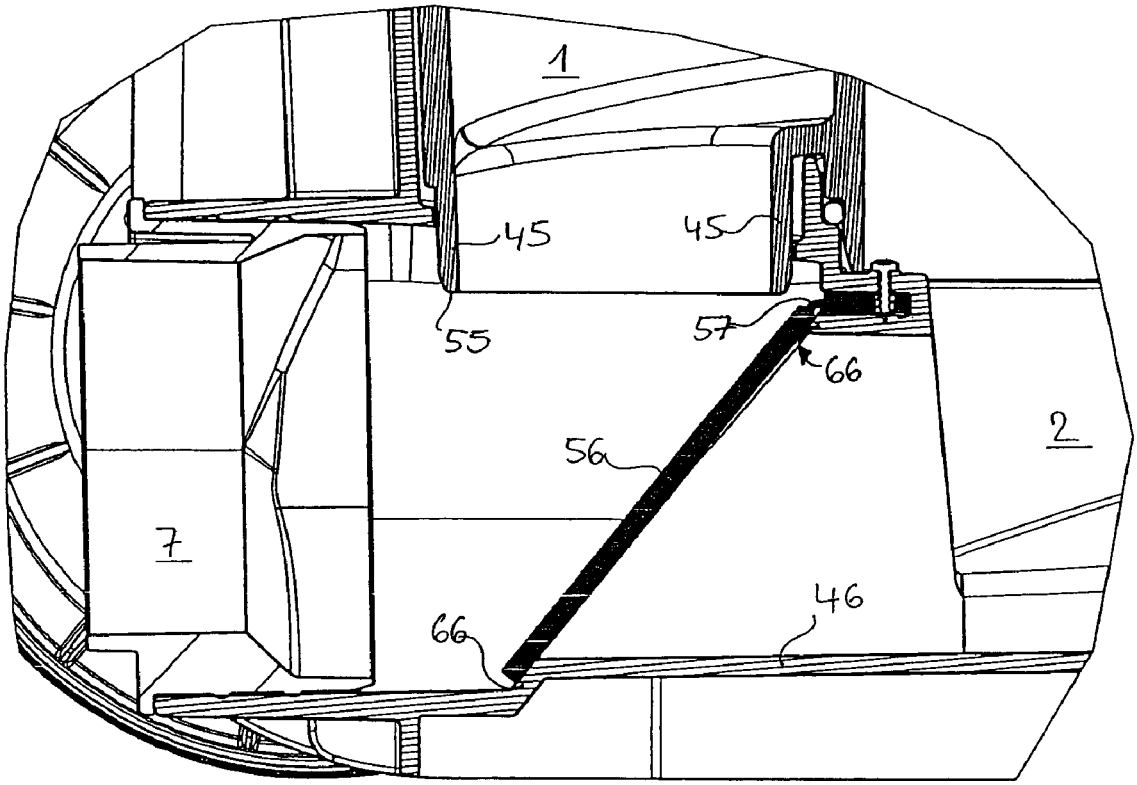
FIG. 13: a detail view in accordance with detail XIII of FIG. 6, again of another embodiment.
Figure 14:
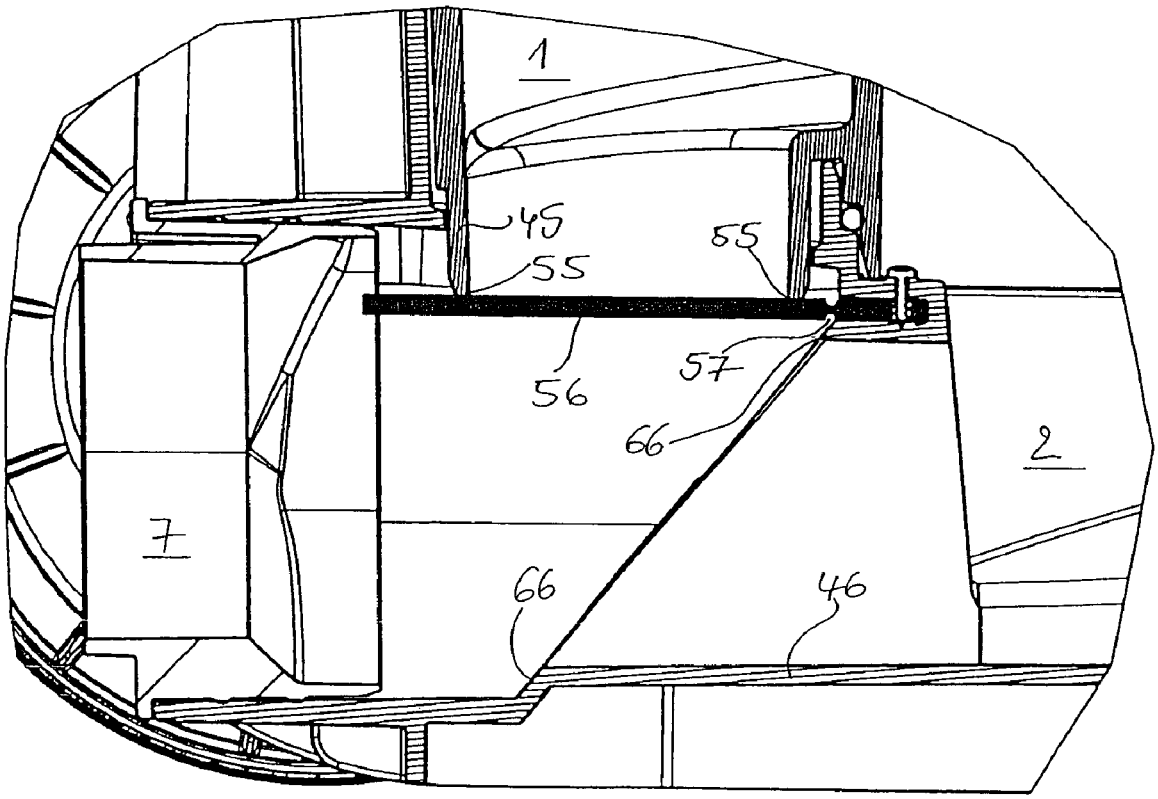
FIG. 14: the object of FIG. 13 in a different fill/drain state.

FIGS. 13 and 14 show another embodiment variant regarding the configuration with two vacuum flaps 5, 6. Instead, as illustrated, preferably a common vacuum flap 56 can be provided that closes off alternatingly the receiving chambers 1, 2. For this purpose, the receiving chambers 1, 2 end at the bottom side in a drainage socket 45, 46, respectively, forming stops 55 and 66 for the vacuum flap 56 at their circumferential edges. The vacuum flap is to be connected so as to be pivotable between these stops 55 and 66. It can be configured preferably as a monolithic part from a single rubber-elastic element, wherein the pivot axis, as illustrated, is formed by an area 57 having reduced thickness. In FIG. 13, the vacuum flap 56 closes off the receiving chamber 2 and releases at the same time the receiving chamber 1 toward the drainage 7 so that liquid can drain therefrom. On the other hand, when vacuum is applied to the receiving chamber 1, the vacuum flap 56 will pivot into the position illustrated in FIG. 14, wherein it closes off the receiving chamber 1 and at the same time releases the receiving chamber 2 allowing the liquid collected therein to drain through the drainage 7. In this connection, the weight force of the liquid collected in the receiving chamber 2 and the vacuum present within the receiving chamber 1 mutually assist one another so that pivoting of the vacuum flap 56 for switching between open/closed can be realized very quickly. In contrast to the configuration of FIG. 2 to FIG. 11, no mutual hindrance can occur as in the case of a possibly delayed movement of the flaps 5, 6.

The illustrated embodiments of FIGS. 2 through 14 are extremely maintenance free, have a mechanically simple configuration, and provide functional safety while providing continuously high aspiration efficiency.

Figure 15:
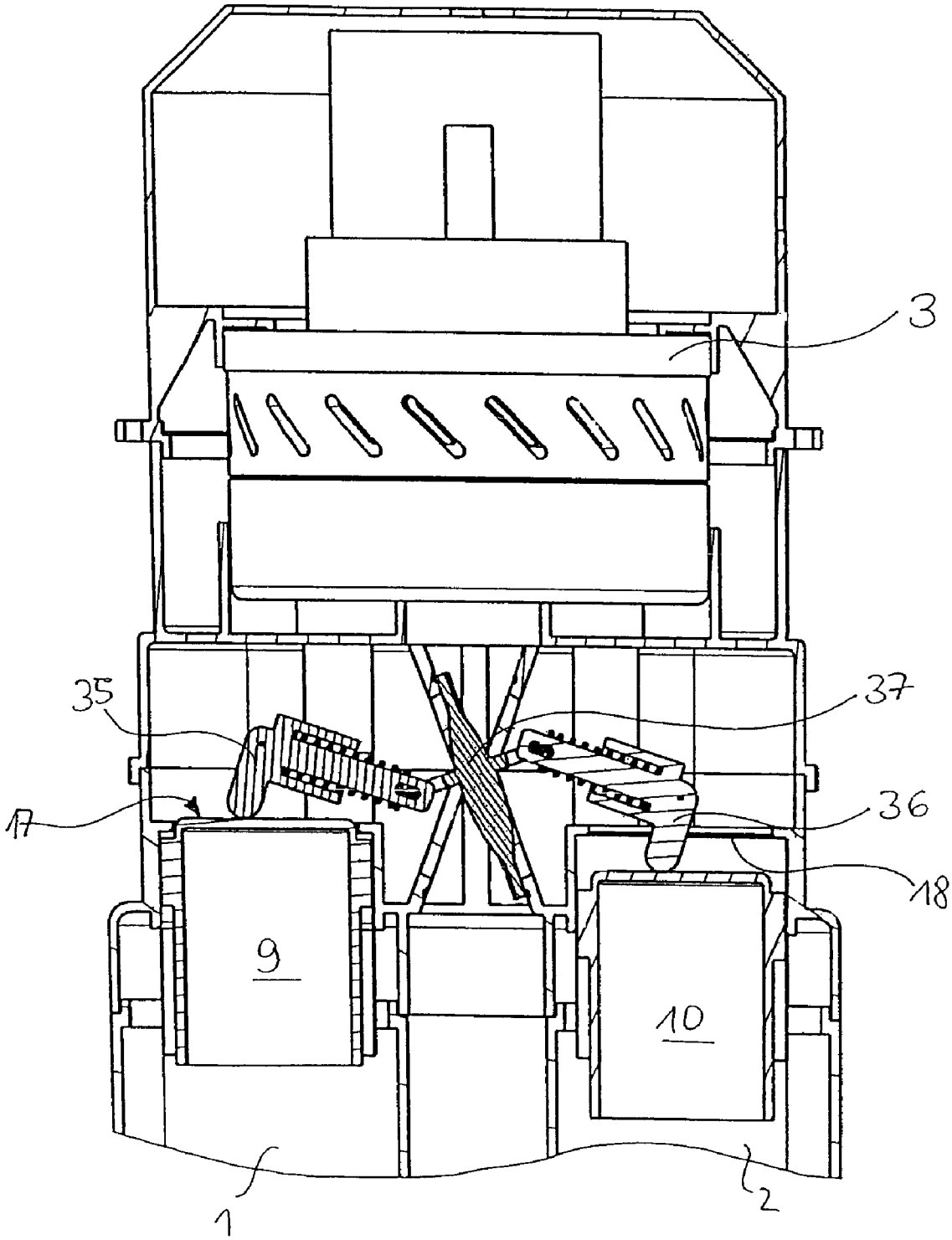
FIG. 15: a partial section according to FIG. 3 of another embodiment of the sludge aspirator of FIGS. 2 to 11.

FIG. 15 shows a modified configuration having also only one aspirator motor 3. The control in regard to from which receiving chamber 1, 2 air is being removed, is realized in the embodiment according to FIG. 15 by a linkage with two switching levers 35, 36 that pivot a switching flap 37 so that the vacuum side of the aspiration motor 3 is connected alternatingly to the receiving chambers 1, 2. The main valves are formed by the switching flap 37.

Figure 16:
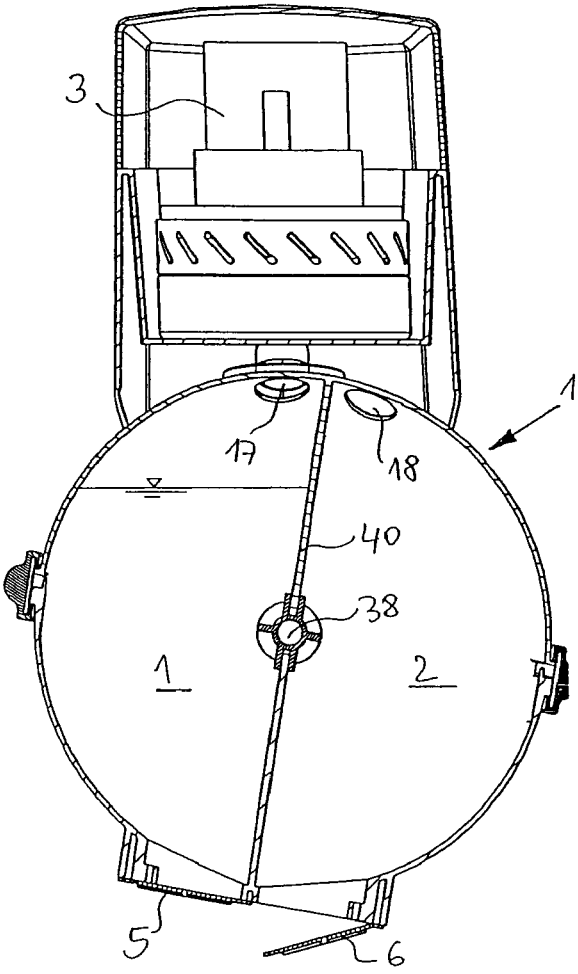
FIGS. 16 and 17: a further single motor embodiment of a liquid aspirator according to the present invention in section.
Figure 17:
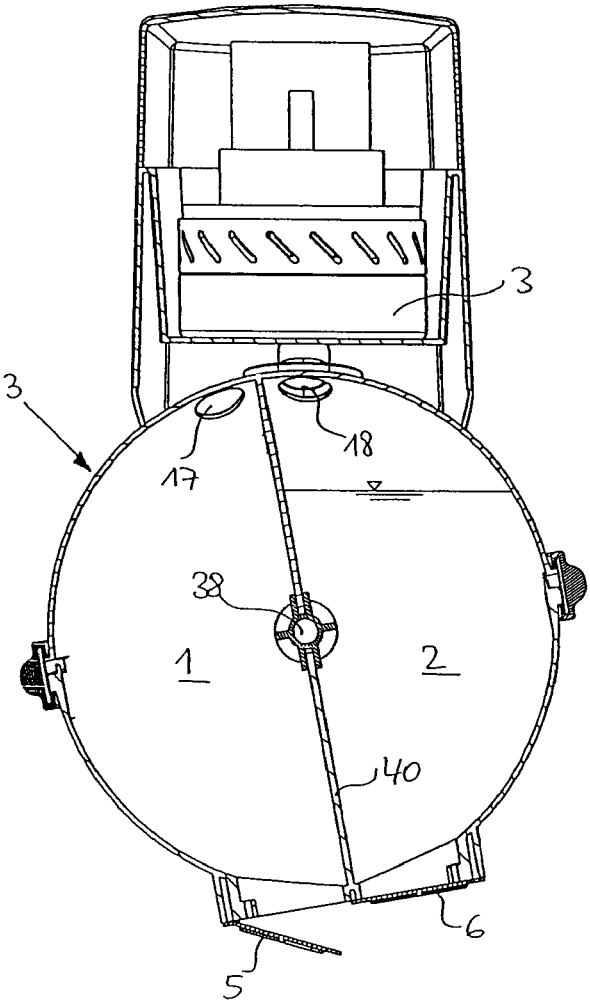

FIGS. 16 and 17 show a further embodiment of a single motor aspirator according to the invention in which the control in regard to which receiving chamber 1, 2 is currently to be filled is provided by the receptacle itself. For this purpose, the receptacle 13 is pivotably supported, preferably, as illustrated, so as to swing about a substantially horizontal axle 38. Each receiving chamber 1, 2 of the receptacle 13 has again an air aspiration opening 17, 18 wherein, by pivoting the receptacle 13, alternatingly one of the air aspiration openings 17, 18 is connected to the vacuum side of the aspirator motor 3 or is separated therefrom. Sealing of the air aspiration openings 17, 18 is simplified when they have the same spacing from the pivot axle or swivel axle 38, in particular when the wall area of the receptacle 13 is curved like a circular segment. In this connection, the air aspiration openings 17, 18 together with the wall of the receptacle 13 also provide main valves as in the configuration of the preceding Figures. The mechanical connection or coupling of the main valves is provided in the embodiment of FIGS. 16 and 17 by the rigid shape of the receptacle 13 itself.

Pivoting of the receptacle 13 can be realized by a motor, in particular, by time control. Preferably, the receptacle 13 is however divided into receiving chambers 1, 2 in such a way that with increasing filling with liquid of a first receiving chamber 1, 2 and simultaneous drainage of liquid from the second receiving chamber 2, 1, the center of gravity will shift. In this way, the receptacle 13 will automatically move into a position that will release the second receiving chamber 2, 1 for filling while the first receiving chamber 1, 2 will drain. Such a separation is provided in a preferred, simple way in that the receptacle 13, as illustrated, is substantially in the form of a horizontal cylinder or a sphere and is divided by a partition 40 into two receiving chambers 1, 2 with substantially semi-circular cross-section. Preferably, the air aspiration openings 17, 18 are to be arranged adjacent on either side of the partition 40 and the drainage openings in the form of vacuum flaps 5, 6 are also arranged on either side of the partition 40 at opposed ends. In FIG. 16, the air aspiration opening 17 is connected to the vacuum side of the aspirator motor 3 so that liquid is sucked in through a vacuum connector, not illustrated, into the receiving chamber 1. At the same time, the other air aspiration opening 18 of the other receiving chamber 2 is connected to the pressure side of the vacuum motor 3 or to the surrounding air so that under the weight of the liquid contained in the receiving chamber 2 the vacuum flap 6 opens and the liquid can drain from the receiving chamber 2. Because of the increasing filling level of the receiving chamber 1 and drainage from the receiving chamber 2, the center of gravity will shift in the receptacle 13 so that the receptacle will pivot automatically about pivot axle 38 from FIG. 16 to FIG. 17 in counterclockwise direction so that in FIG. 17 liquid will be sucked into the receiving chamber 2 and liquid can flow out of the receiving chamber 1.

All of the embodiments according to the invention are characterized by the possibility of a continuous liquid aspiration operation so that the aspiration speed in comparison to conventional liquid aspirators with same motor power is doubled. The liquid aspirators according to the invention are suitable preferably as sludge aspirators for cleaning garden ponds. They can however also be used for conveying other liquids, even when they contain many solids and/or have a higher viscosity, for example, construction materials such as wash floor materials, plaster materials, or the like.

What is claimed is:

1. A liquid aspirator, in particular for liquids containing solids, the liquid aspirator comprising:

a housing comprising a receptacle and a lid;

at least one aspirator motor arranged in the housing;

the receptacle enclosing at least two receiving chambers for liquid, each of the at least two receiving chambers having an air aspiration opening that is connected to a vacuum side of the at least one aspirator motor and is provided with a main valve;

a vacuum connector connected to the receptacle, wherein liquid is sucked into the receptacle through the vacuum connector with the at least one aspirator motor, wherein a section of the vacuum connector arranged inside the receptacle has for each one of the at least two receiving chambers a separate closeable opening so that the vacuum connector communicates separately with each one of the at least two receiving chambers;

a drainage connected to the receptacle through which drainage liquid contained in the receptacle drains from the receptacle;

a control that acts on the main valves so as to alternatingly open and close the air aspiration openings so that the at least two receiving chambers are alternatingly filled with liquid through the closeable openings of the vacuum connector, respectively, and so that one of the at least two receiving chambers currently not being filled is drained.

2. The liquid aspirator according to claim 1, wherein the at least two receiving chambers each have one of the at least one aspirator motor alternatingly switched on and off by the control.

3. The liquid aspirator according to claim 1, wherein the at least one aspirator motor is actuated by the control for alternating aspiration of liquid into the at least two receiving chambers.

4. The liquid aspirator according to claim 1, wherein the control is a mechanical control.

5. The liquid aspirator according to claim 1, wherein the at least two receiving chambers each are sealed relative to the vacuum side of the at least one aspirator motor by a main valve.

6. The liquid aspirator according to claim 5, wherein the main valves are coupled to one another so as to open and close alternatingly.

7. The liquid aspirator according to claim 6, wherein the main valves are mechanically connected to one another.

8. The liquid aspirator according to claim 7, wherein the main valves are coupled by a linkage.

9. The liquid aspirator according to claim 7, comprising a switching flap that pivots for connecting the vacuum side of the at least one aspirator motor alternatingly to one of the at least two receiving chambers.

10. The liquid aspirator according to claim 9, wherein the switching flap is connected to a linkage comprising two switching levers and forms the main valves.

11. The liquid aspirator according to claim 5, wherein the at least two receiving chambers each have a float secured in a guide.

12. The liquid aspirator according to claim 11, wherein the float is arranged underneath the main valve, respectively, so that a rise of liquid in the at least two receiving chambers past a predetermined level forces the float against the main valve and closes the main valve, respectively.

13. The liquid aspirator according to claim 12, wherein the guide has a lower area with penetrations and an upper area that is closed circumferentially, wherein the guide surrounds in the upper area sealingly the float when lifted.

14. The liquid aspirator according to claim 11, wherein the at least two receiving chambers each are sealingly connected by an auxiliary valve to an exhaust side of the at least one aspirator motor.

15. The liquid aspirator according to claim 14, wherein a connection of the exhaust side of the at least one aspirator motor to the at least two receiving chambers is realized by the guide, respectively.

16. The liquid aspirator according to claim 15, wherein a connecting channel extends from a side of the auxiliary valve facing away from the exhaust side of the aspirator motor to the float neighboring the auxiliary valve, respectively.

17. The liquid aspirator according to claim 16, wherein the main valve and the auxiliary valve of each one of the at least two receiving chambers are coupled to open and close alternatingly.

18. The liquid aspirator according to claim 17, wherein the main valves and the auxiliary valves are coupled mechanically.

19. The liquid aspirator according to claim 18, wherein the main valves are coupled by a first rocker.

20. The liquid aspirator according to claim 19, wherein the auxiliary valves are coupled by a second rocker.

21. The liquid aspirator according to claim 20, wherein the first and second rockers are rigidly connected to one another.

22. The liquid aspirator according to claim 1, wherein the at least two receiving chambers have essentially a cylindrical shape.

23. The liquid aspirator according to claim 1, wherein the at least two receiving chambers have identical volume.

24. The liquid aspirator according to claim 1, wherein the at least two receiving chambers are arranged one inside the other.

25. The liquid aspirator according to claim 1, wherein the at least two receiving chambers have a bottom side that is closable by a common vacuum flap supported pivotably between two stops such that, when the vacuum flap rests against one of the two stops, the vacuum flap closes off a first one of the at least two receiving chambers and opens a second one of the at least two receiving chambers toward the drainage.

26. The liquid aspirator according to claim 1, wherein the receptacle is pivotably supported.

27. The liquid aspirator according to claim 26, wherein the receptacle is supported so as to swing about a substantially horizontal axle.

28. The liquid aspirator according to claim 27, wherein the at least two receiving chambers each have an air aspiration opening and the air aspiration openings are alternatingly connected to a vacuum side of the at least one aspirator motor by pivoting the receptacle.

29. The liquid aspirator according to claim 28, wherein the air aspiration openings are arranged in a wall area of the receptacle which wall area is curved with a substantially constant radius about a pivot axis of the receptacle.

30. The liquid aspirator according to claim 26, wherein the receptacle is divided into the at least two receiving chambers such that as liquid rises in a first one of the at least two receiving chambers, a center of gravity of the receptacle shifts, causing the receptacle to automatically pivot into a position that releases a second one of the at least two receiving chambers for filling with liquid.

31. The liquid aspirator according to claim 1, wherein the receptacle in cross-section has substantially a circular shape that is divided by a partition into two of the at least two receiving chambers and said two of the at least two receiving chambers each have a substantially semi-circular cross-section.

32. The liquid aspirator according to claim 31, wherein the two receiving chambers each have an air aspiration opening and the air aspiration openings are alternatingly connected to a vacuum side of the at least one aspirator motor, wherein the air aspiration openings are arranged adjacent one another on opposite sides of the partition and have closable drainage openings positioned opposite one another relative to the partition.

* * * * *